US007962997B2

(12) United States Patent
Chung et al.

(10) Patent No.: US 7,962,997 B2
(45) Date of Patent: Jun. 21, 2011

(54) SUCTION HEAD FOR MOBILE ROBOT

(75) Inventors: Moon-kee Chung, Seoul (KR); Young-Gyu Jung, Incheon (KR)

(73) Assignee: LG Electronics Inc., Seoul (KR)

( * ) Notice: Subject to any disclaimer, the term of this patent is extended or adjusted under 35 U.S.C. 154(b) by 1133 days.

(21) Appl. No.: 11/686,059

(22) Filed: Mar. 14, 2007

(65) Prior Publication Data

US 2007/0214601 A1 Sep. 20, 2007

(30) Foreign Application Priority Data

Mar. 15, 2006 (KR) ..... 10-2006-0024035

(51) Int. Cl.
*A47L 9/02* (2006.01)

(52) U.S. Cl. ..... 15/415.1; 15/422.1

(58) Field of Classification Search ..... 15/415.1, 15/419, 420, 422.1
See application file for complete search history.

(56) References Cited

U.S. PATENT DOCUMENTS 5,513,418 A * 5/1996 Weber ..... 15/383
6,058,561 A * 5/2000 Song et al. ..... 15/387
6,122,798 A * 9/2000 Kobayashi et al. ..... 15/387
6,237,188 B1 * 5/2001 Takemoto et al. ..... 15/346
6,237,189 B1 * 5/2001 Maurer et al. ..... 15/383
6,772,475 B2 * 8/2004 Weber et al. ..... 15/383
7,059,012 B2 * 6/2006 Song et al. ..... 15/340.3
7,320,149 B1 * 1/2008 Huffman et al. ..... 15/320
7,346,428 B1 * 3/2008 Huffman et al. ..... 700/245
7,761,954 B2 * 7/2010 Ziegler et al. ..... 15/320
2003/0192144 A1 * 10/2003 Song et al. ..... 15/346
2003/0229421 A1 * 12/2003 Chmura et al. ..... 700/245
2004/0074038 A1 4/2004 Im et al.
2004/0143927 A1 * 7/2004 Haegermarck et al. ..... 15/319
2004/0211030 A1 10/2004 Nam et al.
2004/0211444 A1 * 10/2004 Taylor et al. ..... 134/18
2004/0221421 A1 * 11/2004 Weber et al. ..... 15/415.1
2005/0273970 A1 12/2005 Cho et al.
2007/0137153 A1 * 6/2007 Oh et al. ..... 55/385.1
2008/0052867 A1 * 3/2008 Park ..... 15/319
2008/0140255 A1 * 6/2008 Ziegler et al. ..... 700/245
2008/0155768 A1 * 7/2008 Ziegler et al. ..... 15/4

* cited by examiner

*Primary Examiner* — Shay L Karls
(74) *Attorney, Agent, or Firm* — Birch, Stewart, Kolasch & Birch, LLP

(57) ABSTRACT

A suction head is provided for removing debris from a surface. The suction head includes a suction nozzle which has a generally semi-circular groove formed on an interior surface of the suction nozzle. Additionally, there is a suction hole formed at a generally central region of a rear surface of the nozzle and communicating with the semi-circular groove. Further, a uniform pressure forming region is provided at a longitudinally extending side of the semi-circular groove, and a suction pipe is mounted to the suction hole to guide air in the semi-circular groove through the suction hole.

19 Claims, 8 Drawing Sheets

SUCTION HEAD FOR MOBILE ROBOT

CROSS-REFERENCE TO RELATED APPLICATION

The present application is related to Korean Application No. 10-2006-0024035, filed Mar. 15, 2006, the content of which is expressly incorporated herein in its entirety.

BACKGROUND OF THE INVENTION

1. Field of the Invention

The present invention relates to a cleaning mobile robot, and more particularly to a suction head of a mobile robot capable of uniformly sucking foreign substances and dust by uniformly distributing a suction pressure.

2. Description of the Related Art

Generally, a cleaning mobile robot automatically cleans a section to be cleaned while moving by itself, without a separate manipulation of a user. If the power source of a charger is depleted, the mobile robot moves to a charging die to charge itself. Further, if the charging is completed, the mobile robot moves to the place which had been cleaned and continuously performs cleaning.

FIG. 1 is a bottom view schematically showing a conventional mobile robot. FIG. 2 is a perspective view showing the bottom surface of the conventional suction head. FIG. 3 is a side cross-sectional view showing a main portion of the conventional suction head.

As shown in the figures, the cleaning mobile robot 1 includes a suction fan 2 driven by a motor 2*a* to generate a suction force, a dust tub 3 in communication with the suction fan 2 and having a filter, a suction head 4 installed on one side surface of the dust tub 3 so as to communicate with the dust tub 3 and to suck the dust on the floor surface with a suction force generated by the suction fan 2, and a brush 5 driven in the inner side of the suction head 4.

The mobile robot 1 sucks dust raised by the rotating brush 5 through the suction head 4 using a suction force generated by the suction fan 2 while traveling by itself using drive wheels 6 provided on the bottom surface thereof.

The suction head 4 includes a suction nozzle 4*a* in which a semi-circular groove 4*c* is formed on the lower surface so that the brush 5 can be provided on the inner side thereof and in which a suction hole 4*d* is formed on one side of the upper surface so as to be communicated with the semi-circular groove 4*c* and a suction pipe 4*b* mounted between the suction hole 4*d* and the dust tub 3 so that the air having the foreign substances sucked in the semi-circular groove 4*c* can be guided to the dust tub 3 through the suction hole 4*d*.

However, the conventional mobile robot has the following problems.

Since the suction hole is formed on one side of the upper surface of the suction nozzle to generate a suction force through the suction pipe mounted to the suction hole, a suction pressure is excessively applied to the semi-circular groove corresponding to a portion close to the suction hole on the inner side of the semi-circular groove of the suction nozzle and a relatively very low suction pressure is applied to a portion of the semi-circular groove which is remote from the suction hole, so that the suction pressure cannot be uniformly distributed on the inner side of the semi-circular groove.

Further, since the suction pressure is not uniformly distributed on the inner side of the suction nozzle, the suction efficiency and thus the cleaning efficiency are remarkably (or substantially) deteriorated.

SUMMARY OF THE INVENTION

Accordingly, the present invention has been made to solve the above-mentioned problems occurring in the prior art. In this regard, at least one object of the present invention is to provide a suction head of a mobile robot which is capable of uniformly sucking foreign substances (or any other debris) and dust by uniformly distributing a suction pressure.

It is another object of the present invention to provide a suction head of a mobile robot capable of softly and stably performing suction of air containing foreign substances.

In order to achieve the above-mentioned objects, the suction head of the mobile robot according to the present invention includes a suction nozzle mounted to a lower surface of the mobile robot, the suction nozzle may have a generally semi-circular groove formed on the lower surface (i.e., an interior) thereof so as to have a brush in the interior thereof and a suction hole formed at a central portion of the rear surface to communicate with the semi-circular groove; a suction pipe mounted to the suction hole to guide air having foreign substances (or any other debris) sucked (e.g., suctioned or vacuumed) in the semi-circular groove through the suction hole; and a uniform pressure forming section (or region) formed on the inner side (or a longitudinally extending side) of the semi-circular groove so that a suction pressure can be uniformly distributed on the inner side of the semi-circular groove.

Further, the uniform pressure forming section (or region) may include an air distributing groove formed at an upper portion of the inner side (or a longitudinally extending side) of the semi-circular groove and having a space that widens as it extends from a portion close to the suction hole to a portion remote from the suction hole (e.g., as the semi-circular groove extends from a central region of the nozzle towards the longitudinal ends thereof).

Further, the suction nozzle may include a pair of suction guide surfaces connected to (or in communication with) the air distributing groove and formed on sides (e.g., oppositely facing sides) of the suction hole so as to be inclined with respect to the inner side of the semi-circular groove thereby guiding air to the suction hole.

Further, the suction pipe may include an inclined pipe (or an inclined region) mounted to the suction hole and inclined from the suction hole to the upper side and a vertical pipe (or a vertical region) vertically formed at the tip end of the inclined pipe.

Further, the suction pipe may include an inclined surface section (or tapered front end) formed at the circumference of an inner side of a tip end of the inclined pipe so as to be inclined, e.g., with respect to the suction hole. In this regard, the inclined surface section may be adhered to (or provided contiguous with) the suction guide surface.

Further, an inclination angle of the inclined pipe may be larger than an angle between a segment drawn between the rotational center point of the brush and a middle point of the inner side height of the suction hole and a horizontal line drawn from the rotational center point of the brush.

Further, a highest point defined on the inner side of the tip point of the inclined pipe corresponding to the suction hole may be identical to (or approximately the same as) a highest point defined on a circumference of the brush. Further, a segment drawn (or defined by) a line that passes through a lowest point defined on an inner side of the tip end of the inclined pipe and a lowest point defined on a circumference of the brush may form an angle of about 30 degrees in the counter-clockwise direction with respect to a bottom surface of the nozzle.

Further, a ratio of an inner side width of the suction pipe to a horizontal length of the suction nozzle may be about 0.13 to about 0.18.

BRIEF DESCRIPTION OF THE DRAWINGS

The present invention is further described in the detail description which follows, in reference to the noted plurality of drawings, by way of non-limiting examples of preferred embodiments of the present invention, in which like characters represent like elements throughout the several views of the drawings, and wherein.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice Hereinafter, a non-limiting embodiment of the present invention will be described in detail with reference to the accompanying drawings.

Figure 1:
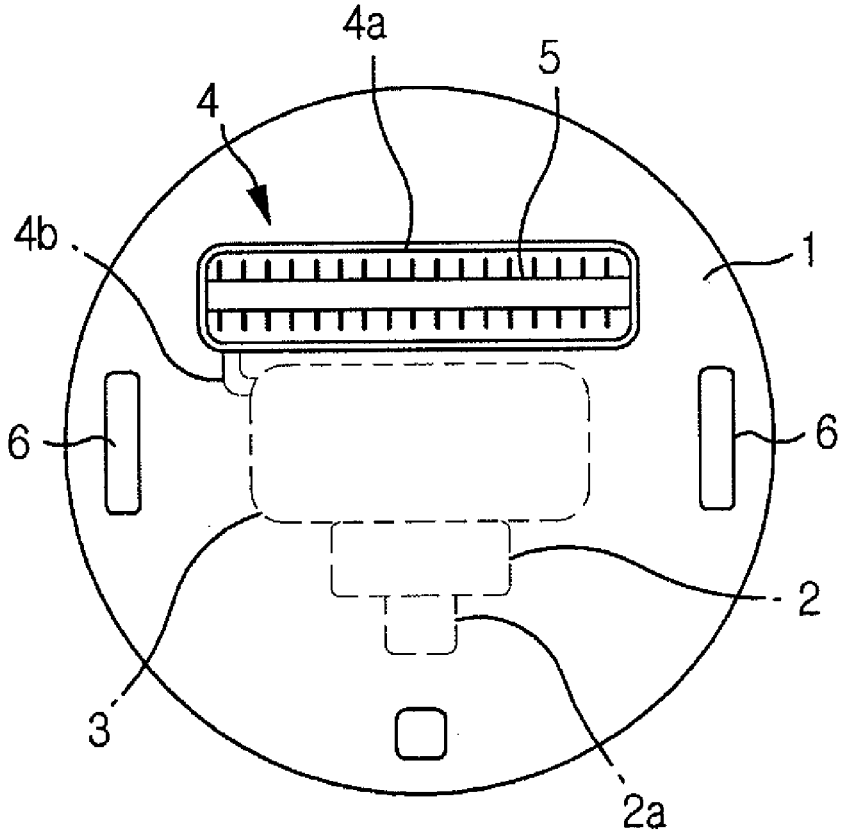
FIG. 1 is a bottom view schematically showing a conventional mobile robot.
Figure 2:
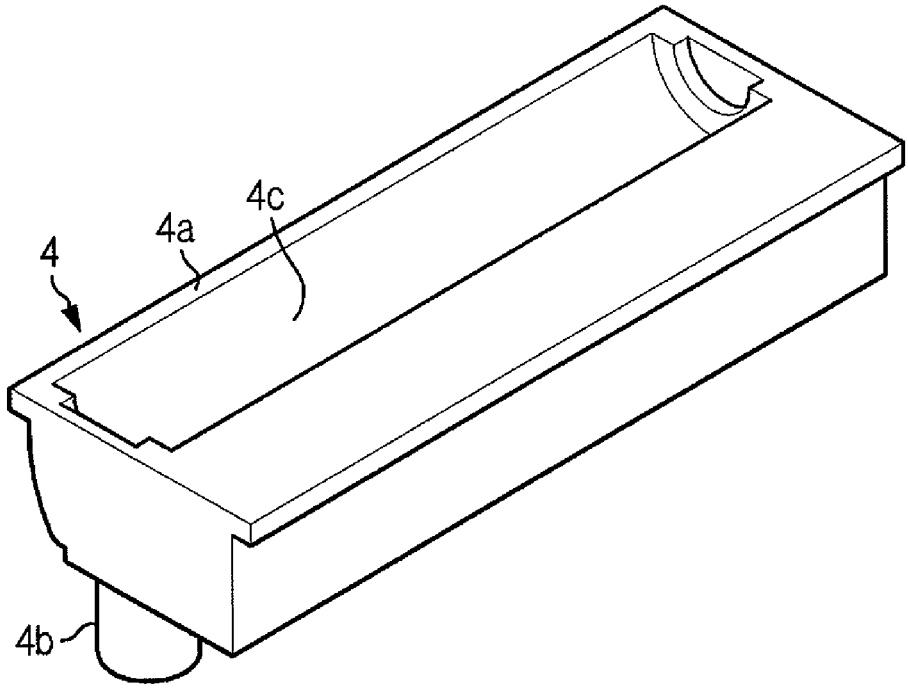
FIG. 2 is a perspective view showing the bottom surface of the conventional suction head.
Figure 3:
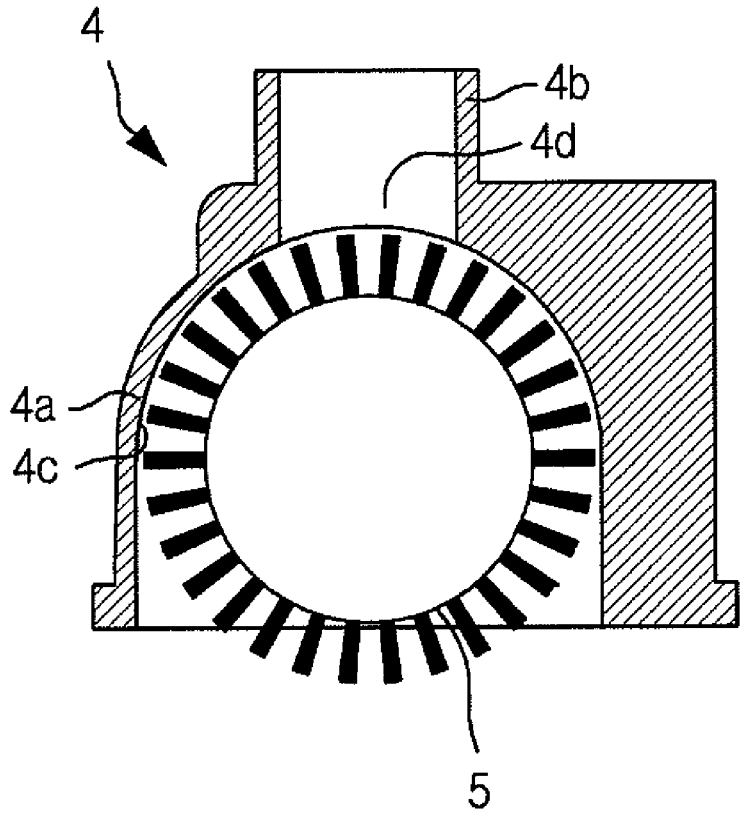
FIG. 3 is a side cross-sectional view showing a main portion of the conventional suction head.
Figure 4:
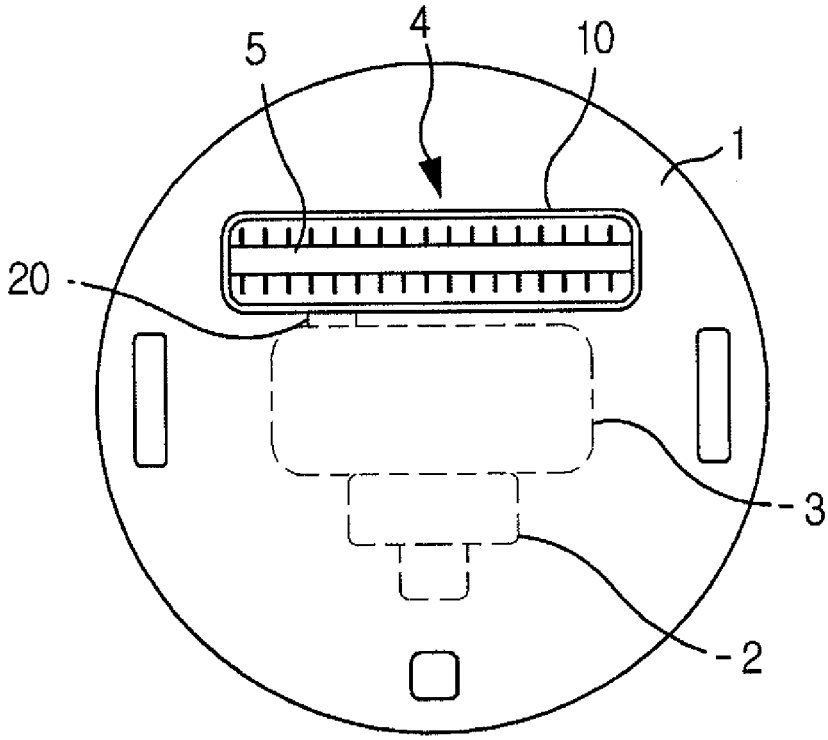
FIG. 4 is a bottom view schematically showing a mobile robot according to the present invention.
Figure 5:
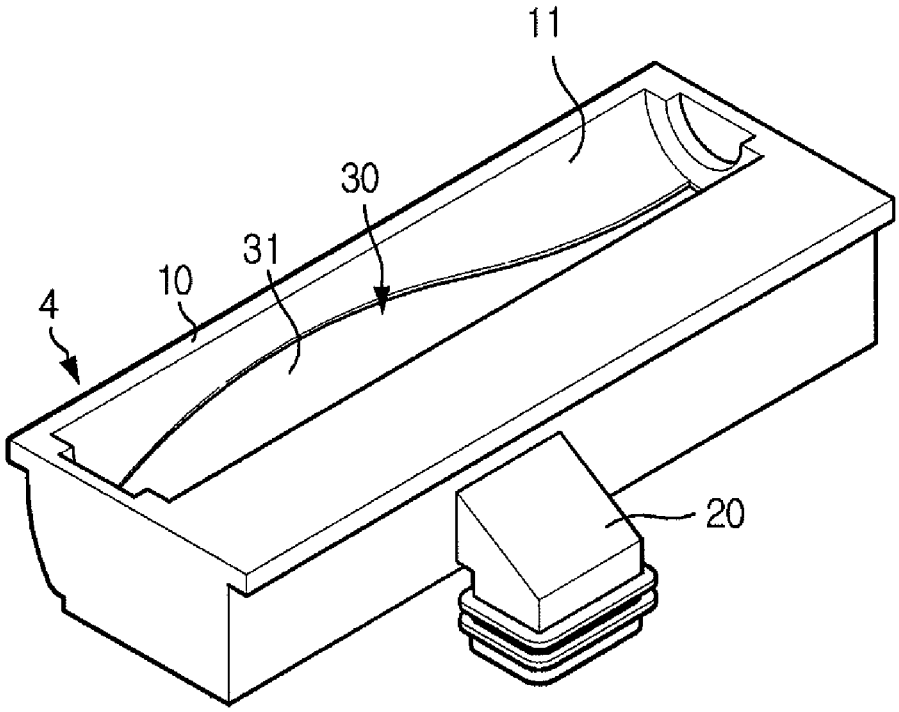
FIG. 5 is a perspective view showing the bottom of the present invention.
Figure 6:
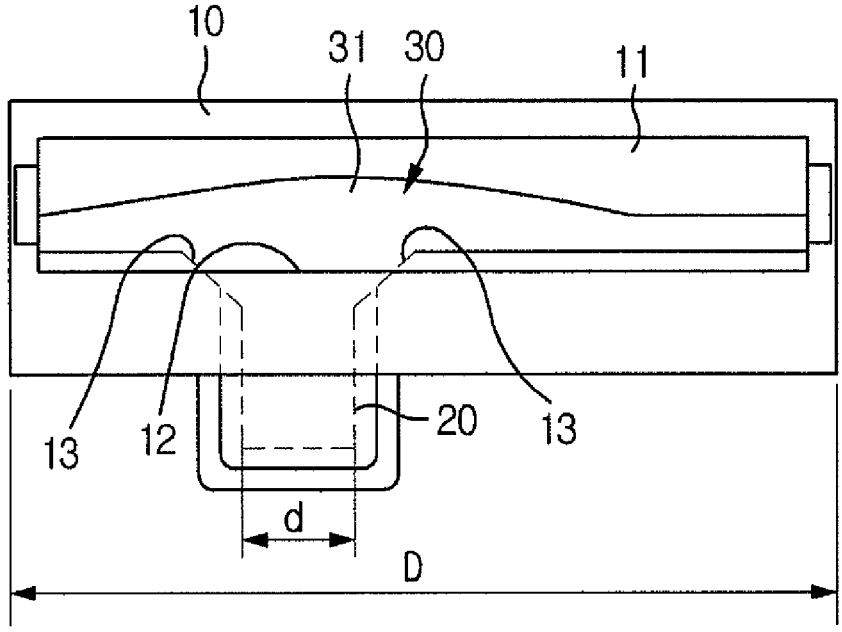
FIG. 6 is a bottom view of the present invention.

FIG. 4 is a bottom view schematically showing a mobile robot according to the present invention. FIG. 5 is a perspective view of the present invention. FIG. 6 is a bottom view of the present invention.

As shown in the figures of the non-limiting embodiment, a suction head 4 includes a suction nozzle 10 mounted to the lower surface of the mobile robot 1, a suction pipe 20 connecting the suction nozzle 10, a dust tub 3, and a uniform pressure forming section (or region) 30 uniformly distributing a suction pressure to the inner side (or a longitudinally extending side) of the suction nozzle 10.

The suction nozzle 10 may include a generally semi-circular groove 11 formed on the lower surface (e.g., an interior surface of the nozzle) thereof so as to include a brush 5 on the inner side thereof (e.g., an interior surface of the nozzle) and a suction hole 12 formed at a central portion (or region) of the rear surface and communication with the semi-circular groove 11.

The suction nozzle 10 sucks dust (or other debris) on the bottom surface by, e.g, a suction force generated by a suction fan 2 through the semi-circular groove 11 and discharges the dust to the suction hole 12, with the brush being installed on the inner side (or the longitudinally extending side) of the semi-circular groove 11 to be driven. Since the suction hole 12 is formed at a position close to a central portion (or region) of the rear surface of the suction nozzle 10 to help solve a disuniformity of the suction pressure.

The suction pipe 20 may be mounted between the suction hole 12 and the dust tub 3 and may be adapted (or configured) to guide air having foreign substances (or any other debris) sucked in the semi-circular groove 11 of the suction nozzle 10 to the dust tub 3 through the suction hole 12. Further, the suction pipe 20 may be formed of a synthetic rubber material so as to have a sealing property and to be easily assembled in the suction hole 12 and the dust tub 3. However, it should be appreciated that the suction pipe can be formed of any suitable material, including, but not limited to plastic and metal.

The uniform pressure forming section (or region) 30 may be formed on the inner side (or a longitudinally extending side) of the semi-circular groove 11 of the suction nozzle 10 so that a suction pressure may be uniformly distributed to the inner side of the semi-circular groove 11 to uniformly suck foreign substances and dust (or other debris), thereby improving the cleaning efficiency.

The uniform pressure forming section (or region) 30 may include an air distributing groove 31 formed at an upper portion of the inner side (or a longitudinally extending side) of the semi-circular groove 11 and may have a space (or dimension) that narrows as it extends from a portion close to the suction hole 12 (e.g., near the central region of the nozzle) to a portion remote from the suction hole 12 (e.g., near the longitudinal extending ends of the nozzle). In other words, the generally semi-circular groove may be wider near the central region or the nozzle than at the longitudinal ends of the nozzle.

That is, the suction pressure generated through the suction hole 12 may be uniformly distributed in the semi-circular groove 11 by widely forming the air distributing groove 31 so that a large amount of air can be distributed at an upper portion of the semi-circular groove 11 which is located at a position close to the suction hole 12 and by narrowly forming the air distributing groove 31 so that a small amount of air can be distributed at an upper portion of the semi-circular groove 11 which is located at a position remote from the suction hole 12 (e.g., near the longitudinal extending ends of the nozzle).

The suction nozzle 10 may also include a pair of suction guide surfaces 13 formed on sides (e.g., oppositely facing sides) of the suction hole 12 so as to be inclined on the inner side of the semi-circular groove 11 (e.g., with respect to the suction hole 12). The suction guide surfaces may be connected to (or otherwise in communication with, for example, contiguous with) the air distributing groove 31 to smoothly introduce the air containing foreign substances (or any other debris) to the suction hole 12.

Further, for example, the ratio of the inner width d of the suction pipe 20 to the horizontal length D of the suction nozzle 10 may be about 0.13 to about 0.18. In this regard, it should be appreciated that if the value of the d/D is less than about 0.13, the suction pipe 20 may be too small when compared with the suction nozzle 10 to perform smooth suction, and if the value of d/D is greater than 0.18, the suction pipe 20 may be too large when compared with the suction nozzle 10 to decrease the suction pressure.

Figure 7:
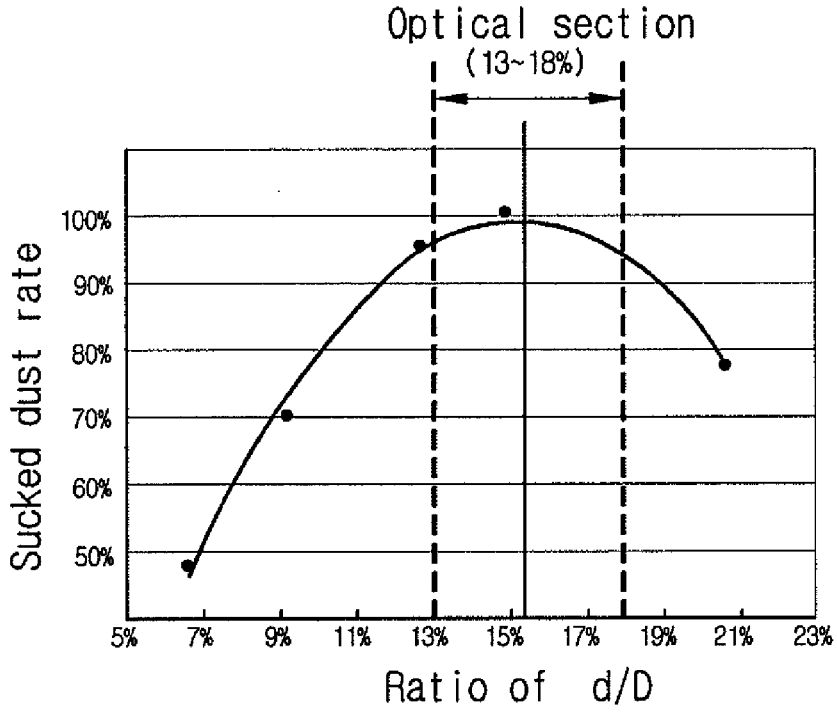
FIG. 7 is a graph showing the cleaning efficiency according to the ratio of the suction nozzle and the suction pipe.

FIG. 7 is a graph showing the cleaning efficiency according to the ratio of the suction nozzle and the suction pipe. In this regard, it should be appreciated that any suitable ratio which improves the suction characteristics of the nozzle may be employed.

The graph shows a retrieving rate of dust sprayed in a predetermined amount to the bottom surface with respect to the ratio of the horizontal length D of the suction nozzle and the inner width d of the suction pipe, i.e. the rate of the sucked dust (e.g., suctioned or vacuumed).

When the rate of the sucked dust is the rate with respect to the amount of the dust sucked through the suction nozzle and the suction pipe when the amount of dust sprayed on the floor is 100.

As represented in the graph, the rate of the sucked dust becomes larger as the ratio of d/D goes from approximately 7% to approximately 15% and the rate of the sucked dust from approximately 15% to 21% becomes gradually smaller.

The optimal section, which has the highest rate of the sucked dust, i.e. the highest cleaning efficiency, may be obtained when the ratio of d/D is about 13% to about 18%. In other words, the optimal section may be obtained when the ratio of d/D is about 0.13 to about 0.18.

Figure 8:
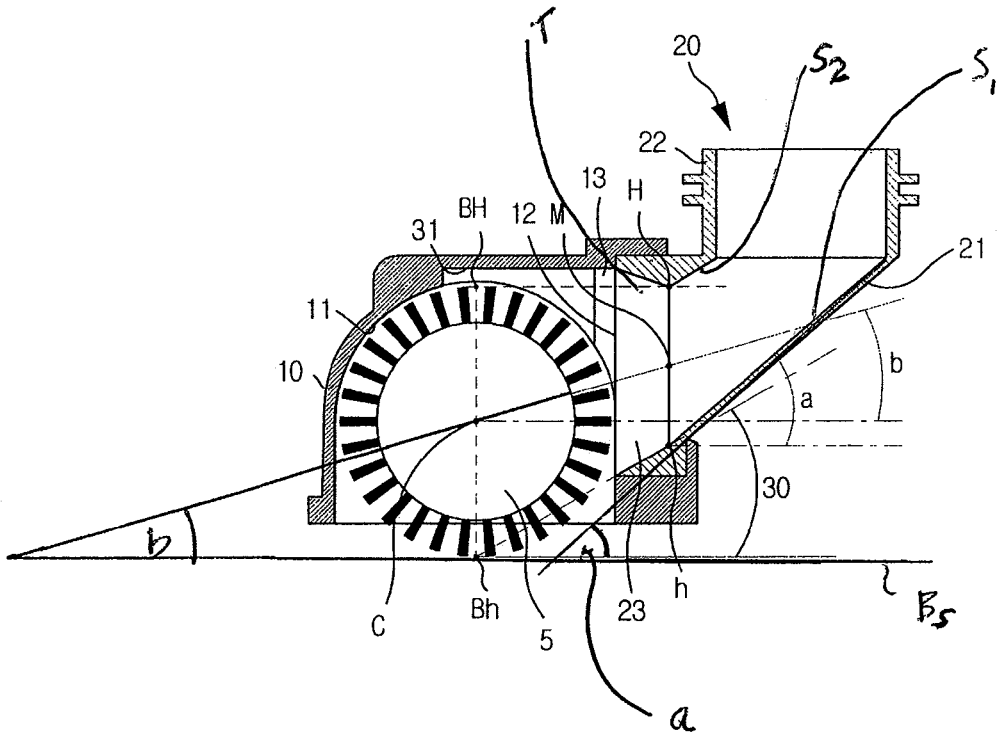
FIG. 8 is a side cross-sectional view of a main portion of the present invention.

FIG. 8 is a side cross-sectional view of a main portion of the present invention. As shown in FIG. 8, the suction pipe 20 may include an inclined pipe (or inclined region) 21 mounted to the suction hole 10 and inclined to the upper side and a vertical pipe (or vertical region) 22 vertically formed at the tip end of the inclined pipe 21.

The inclined pipe 21 smoothly guides the air containing foreign substance (or any other debris) from the suction hole 12 to the upper side and flow the air to the vertical pipe 22. The vertical pipe 22 raises the air containing the foreign substances introduced from the inclined pipe 21 into the interior of a dust tub (not shown).

The suction pipe 20 may also include an inclined surface section 23 (or tapered front end) formed at the circumference of the inner side of the tip end of the inclined pipe 21 so as to be inclined and the inclined surface section 23 may be adhered to (or provided contiguous with) the suction guide surface 13 of the suction nozzle 10. The inclined surface section 23 allows the air which has passed through the suction hole 12 to smoothly flow to the inner side of the inclined pipe 21 in the semi-circular groove 11 and the air distributing groove 31.

It is preferable that the inclination angle "a" of the inclined pipe 21 is larger than an angle b between a segment drawn between the rotational center point C of the brush 5 and a middle point "M" of the inner side height of the suction hole 12 and a horizontal line drawn from the rotational center point "C" of the brush, which is obtained by experiments. This is because when the inclination angle "a" of the inclined pipe 21 is larger than the angle "b", suction is smoothly and stably performed. It is preferable that the highest point H on the inner side of the tip point of the inclined pipe 21 corresponding to the suction hole 12 is identical with the highest point "BH" of the brush 5 and the lowest point "h" of the inner side of the tip end of the inclined pipe 21 is located on a segment drawn when an angle in the counter-clockwise direction from the lowest point "BH" of the brush 5 is 30 degrees, which is obtained by experiments to smoothly suck foreign substances and dust through the inclined pipe 21.

In other words, a first angle (i.e., angle "a") may be defined by an angle formed between an outer surface of the inclined region and a bottom surface of the nozzle $B_s$ which extends generally parallel to a surface to be cleaned. Further, a segment may be defined by a line that passes through both a radial center of the brush "C" and a center of the suction hole "M" at a point where the tapered front end 23 of the pipe intersects an inner surface of the inclined region 21. Additionally, a second angle (i.e., angle "b") may be defined by an angle formed between the segment and a surface $B_s$ parallel to a bottom surface of the nozzle; and the first angle "a" may be larger than the second angle "b".

Further, the brush may have a vertical height extending in a direction generally parallel to the vertical region 22 of the suction pipe 20 and a first (i.e., "BH") point may be defined on a circumference of the brush at a maximum vertical height thereof. Additionally, the suction pipe 20 may include a beveled surface $S_2$ provided opposite an inner surface $S_1$ of the inclined region 21 and a second point "H" defined at an intersection of the beveled surface $S_2$ and the tapered front end "T". Further, the first point "BH" may be at the same or approximately the same vertical height as the second point "H".

Further, a third point (i.e., "h") may be defined at an intersection of the first tapered end 23 and the inner surface $S_1$ of the inclined region 21. Also, a fourth point (i.e., "Bh") may be defined on the circumference of the brush at a minimum vertical height thereof. Additionally, a segment defined by a line passing through the third "h" and fourth "Bh" points may form an angle of approximately 30 degrees with a bottom surface $B_s$ of the nozzle which extends generally parallel to a surface to be cleaned.

As mentioned above, according to the present invention, the suction efficiency is remarkably improved by uniformly sucking foreign substances and dust and thus uniformly distributing a suction pressure, thereby remarkably improving the cleaning efficiency.

Further, according to the present invention, the mobile robot can be simply manufactured and installed by softly and stably sucking the air containing foreign substances with a simple structure, thereby improving the suction efficiency.

It is further noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A suction head for removing debris from a surface, comprising:

a suction nozzle having a generally semi-circular groove formed on an interior surface thereof, a suction hole formed at a generally central region of a rear surface of the nozzle and communicating with the semi-circular groove, and a uniform pressure forming region provided at a longitudinally extending side of the semi-circular groove; and a suction pipe mounted to the suction hole to guide air in the semi-circular groove through the suction hole;

wherein the uniform pressure forming region comprises an air distributing groove having a dimension that varies in a direction which extends generally perpendicular to a longitudinal extent of the nozzle, and wherein the dimension narrows as the air distributing groove extends from the central region of the nozzle towards longitudinal ends of the nozzle.

2. The suction head according to claim 1, wherein the nozzle further comprises a pair of suction guide surfaces provided contiguous with the air distributing groove and formed on opposing sides of the suction hole, wherein the suction guide surfaces are inclined with respect to the longitudinal extent of the nozzle.

3. The suction head according to claim 1, wherein the suction pipe includes an inclined region mounted to the suction hole and inclined with respect to the rear surface of the nozzle, and a vertical region extending generally parallel to the rear surface of the nozzle.

4. The suction head according to claim 3, wherein a tapered front end provided on an inner surface of the suction pipe is contiguous with a pair of suction guide surfaces that communicate with the air distributing groove, and wherein the guide surfaces are formed on opposing sides of the suction hole.

5. The suction head according to claim 4, further comprising a brush provided in the interior of the nozzle.

6. The suction head according to claim 5, comprising:

a first angle defined by an angle formed between an outer surface of the inclined region and a bottom surface of the nozzle which extends generally parallel to a surface to be cleaned;

a segment defined by a line that passes through both a radial center of the brush and a center of the suction hole at a point where the tapered front end of the pipe intersects an inner surface of the inclined region; and a second angle defined by an angle formed between the segment and a bottom surface of the nozzle, wherein the first angle is larger than the second angle.

7. The suction head according to claim 5, wherein the brush has a vertical height extending in a direction generally parallel to the vertical region of the suction pipe and a first point defined on a circumference of the brush at a maximum vertical height thereof;

wherein the suction pipe includes a beveled surface provided opposite an inner surface of the inclined region and a second point defined at an intersection of the beveled surface and the tapered front end; and wherein the first point is at the same or approximately the same vertical height as the second point.

8. The suction head according to claim 7, wherein a third point is defined at an intersection of the first tapered end and the inner surface of the inclined region;

wherein a fourth point is defined on the circumference of the brush at a minimum vertical height thereof; and wherein a segment defined by a line passing through the third and fourth points forms an angle of approximately 30 degrees with a surface which extends generally parallel to a bottom surface of the nozzle.

9. The suction head according to claim 1, wherein the ratio of an inner side width of the suction pipe to a horizontal length of the suction nozzle is about 0.13 to about 0.18.

10. A mobile robot comprising:

a motor;

a suction fan driven by a motor to generate a suction force;

a dust tub in communication with the suction fan;

a suction head configured to remove debris by operation of the suction fan;

a suction nozzle mounted to the mobile robot and having a generally semi-circular groove formed on an interior surface thereof, a suction hole formed at a generally central region of a rear surface of the nozzle and communicating with the semi-circular groove, and a uniform pressure forming region provided at an inner side of the semi-circular groove; and a suction pipe mounted to the suction hole to guide air in the semi-circular groove through the suction hole, wherein the uniform pressure forming region comprises an air distributing groove having a dimension that varies in a direction which extends generally perpendicular to a longitudinal extent of the nozzle, and wherein the dimension narrows as the air distributing groove extends from the central region of the nozzle towards longitudinal ends of the nozzle.

11. The mobile robot according to claim 10, wherein the nozzle further comprises a pair of suction guide surfaces provided contiguous with the air distributing groove and formed on opposing sides of the suction hole, wherein the suction guide surfaces are inclined with respect to the longitudinal extent of the nozzle.

12. The mobile robot according to claim 10, wherein the suction pipe includes an inclined region mounted to the suction hole and inclined with respect to the rear surface of the nozzle, and a vertical region extending generally parallel to the rear surface of the nozzle.

13. The mobile robot according to claim 12, wherein a tapered front end provided on an inner surface of the suction pipe is contiguous with a pair of suction guide surfaces that communicate with the air distributing groove, and wherein the guide surfaces are formed on opposing sides of the suction hole.

14. The mobile robot according to claim 13, further comprising a brush provided in the interior of the nozzle.

15. The mobile robot according to claim 14, comprising:

a first angle defined by an angle formed between an outer surface of the inclined region and a bottom surface of the nozzle which extends generally parallel to a surface to be cleaned;

a segment defined by a line that passes through both a radial center of the brush and a center of the suction hole at a point where the tapered front end of the pipe intersects an inner surface of the inclined region; and a second angle defined by an angle formed between the segment and a bottom surface of the nozzle, wherein the first angle is larger than the second angle.

16. The mobile robot according to claim 14, wherein the brush has a vertical height extending in a direction generally parallel to the vertical region of the suction pipe and a first point defined on a circumference of the brush at a maximum vertical height thereof;

wherein the suction pipe includes a beveled surface provided opposite an inner surface of the inclined region and a second point defined at an intersection of the beveled surface and the tapered front end; and wherein the first point is at the same or approximately the same vertical height as the second point.

17. The mobile robot according to claim 16, wherein a third point is defined at an intersection of the first tapered end and the inner surface of the inclined region;

wherein a fourth is defined on the circumference of the brush at a minimum vertical height thereof; and wherein a segment defined by a line passing through the third and fourth points forms an angle of approximately 30 degrees with a bottom surface of the nozzle which extends generally parallel to a surface to be cleaned.

18. The mobile robot according to claim 10, wherein the ratio of an inner side width of the suction pipe to a horizontal length of the suction nozzle is about 0.13 to about 0.18.

19. A mobile robot comprising:

a suction head configured to remove debris from a surface;

a suction nozzle mounted to the mobile robot and having a generally semi-circular groove formed on an interior surface thereof, a suction hole formed at a generally central region of a rear surface of the nozzle and communicating with the semi-circular groove, and a uniform pressure forming region provided at an inner side of the semi-circular groove; and a suction pipe mounted to the suction hole to guide air in the semi-circular groove through the suction hole, wherein the uniform pressure forming region comprises an air distributing groove having a dimension that varies in a direction which extends generally perpendicular to a longitudinal extent of the nozzle, and wherein the dimension narrows as the air distributing groove extends from the central region of the nozzle towards longitudinal ends of the nozzle.

* * * * *